US006750824B1

(12) United States Patent
Shen

(10) Patent No.: US 6,750,824 B1
(45) Date of Patent: Jun. 15, 2004

(54) CAR ANTENNA SEAT

(75) Inventor: Shun-Tian Shen, San Chung (TW)

(73) Assignee: Janchy Enterprise Co., Ltd., San Chung (TW)

( * ) Notice: Subject to any disclaimer, the term of this patent is extended or adjusted under 35 U.S.C. 154(b) by 0 days.

(21) Appl. No.: 10/331,484

(22) Filed: Dec. 31, 2002

(51) Int. Cl.[7] ..... H01Q 1/06
(52) U.S. Cl. ..... 343/713; 343/721; 343/894
(58) Field of Search ..... 343/711, 713, 343/715, 720, 721, 760, 894

(56) References Cited

U.S. PATENT DOCUMENTS 3,842,397 A * 10/1974 Sindle ..... 367/111
4,300,116 A * 11/1981 Stahovec ..... 340/904
5,417,178 A * 5/1995 Harrelson, II ..... 114/343
5,493,269 A * 2/1996 Durley et al. ..... 340/433
6,313,800 B1 * 11/2001 Kallina ..... 343/715
6,377,222 B1 * 4/2002 Nicholson ..... 343/713
2002/0033776 A1 * 3/2002 Kallina ..... 343/711

* cited by examiner

*Primary Examiner*—Tho Phan
(74) *Attorney, Agent, or Firm*—Bacon & Thomas PLLC

(57) ABSTRACT

Car antenna seat including a main body composed of two casings, a transparent antenna rod and a pivot rod. Several LED are respectively disposed on upper and lower faces of a fixing plate disposed in the main body. Transparent decorative boards are disposed on the casings, permitting light to pass therethrough. The transparent antenna rod is fixed on the main body. An antenna is fitted around the antenna rod. The pivot rod is pivotally connected with the bottom of the main body. A bulb set is disposed in a base of the antenna rod. The bulb set includes a color-changeable bulb and a controlling circuit board. The color-changeable bulb is controlled by the circuit board to flicker and change the color, whereby the transparent antenna rod can present different colors or flicker. By means of adaptable screw, the bottom end of the pivot rod is locked with a holder or fixing tray. The car antenna seat emits light to achieve a warning effect and a decorative effect.

7 Claims, 4 Drawing Sheets

CAR ANTENNA SEAT

BACKGROUND OF THE INVENTION

The present invention is related to a car antenna seat which is able to emit light to achieve an indicating and warning effect as well as a unique decorative effect.

A conventional car antenna is telescopic and wrapped by a rubber skin. Such antenna is flexible to a certain extent. In order to additionally install video/audio equipment such as a television in the car, an additional antenna is added to the car for achieving better receiving effect. The conventional car antenna seat is monotonous and has only single function. Also, the conventional car antenna seat is not freely replaceable and lacks decorative effect.

SUMMARY OF THE INVENTION

It is therefore a primary object of the present invention to provide a car antenna seat which is able to emit light to achieve an indicating and warning effect as well as a unique decorative effect.

The present invention can be best understood through the following description and accompanying drawings wherein:

DETAILED DESCRIPTION OF THE PREFERRED EMBODIMENTS

Figure 1:
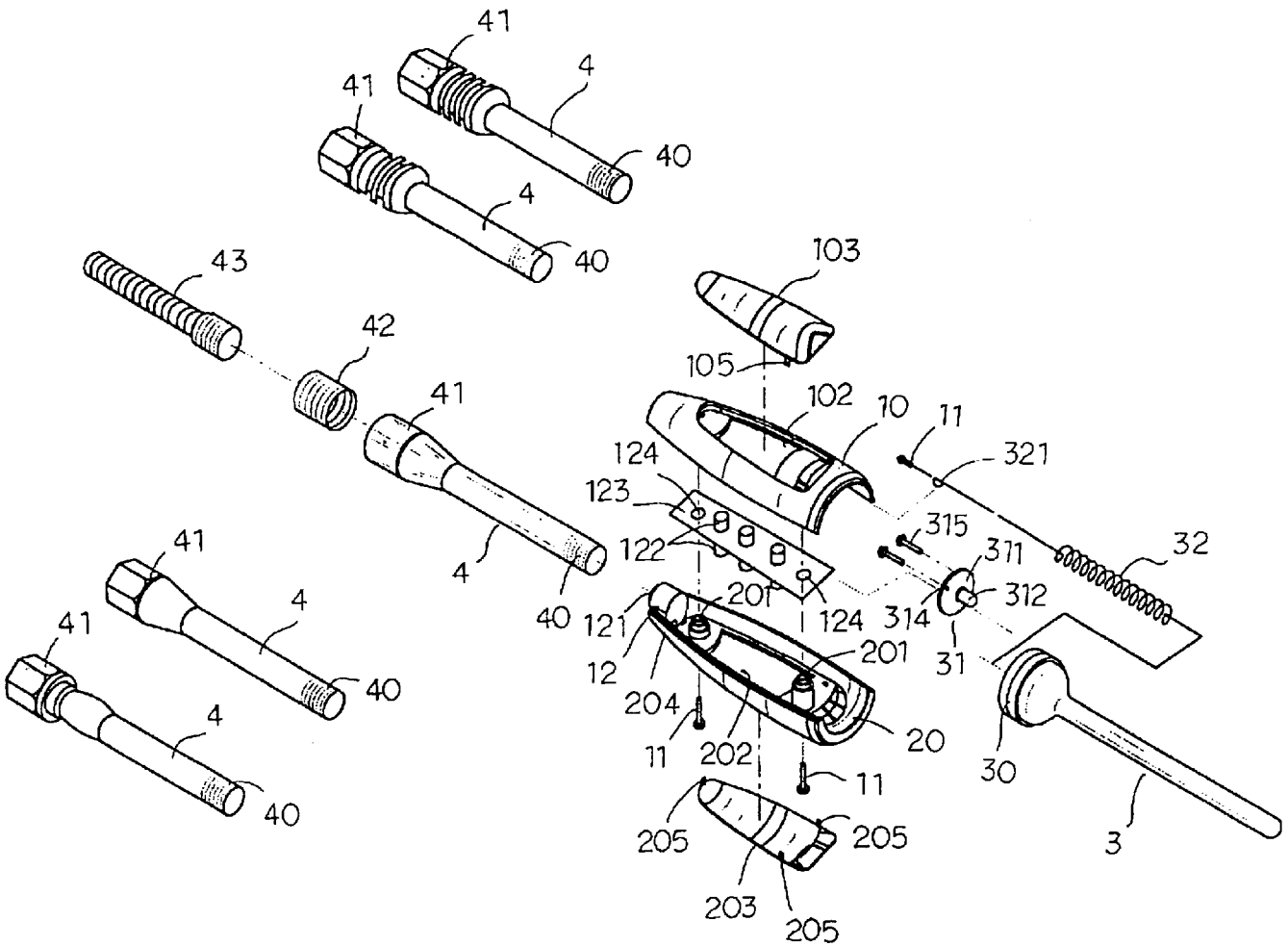
FIG. 1 is a perspective exploded view of the present invention.

Please refer to FIG. 1. The car antenna seat of the present invention includes a main body 1 composed of a pair of cooperative casings 10, 20, a transparent antenna rod 3 and a pivot rod 4.

The inner face of each of the two casings 10, 20 is formed with two connecting seats 101, 201 corresponding to the other. The connecting seats 101, 201 are fitted in two screw holes 124 of two ends of a fixing plate 123. Several LED 122 are respectively disposed on upper and lower faces of the fixing plate 123. Screws 11 are passed through the screw holes 124 to lock the two casings into an integral body. The center of each casing is formed with a window 102, 202 sealed by a transparent decorative board 103, 203. One end of the main body 1 has a larger circular hole in which a base 30 of bottom end of the transparent antenna rod 3 is inlaid and located. The other end of the main body has a smaller circular hole in which a threaded seat 12 is fixed. One end of the threaded seat 12 is formed with a thread hole 121. The pivot rod 4 is screwed and located in the thread hole 121.

A wire hole 204 is formed on one casing 20 near the threaded seat 12 for wire to pass therethrough.

The peripheries of the decorative boards 103, 203 are formed with tenons 105, 205 for firmly associating the decorative boards with the casings 10, 20.

The antenna rod 3 has a straight rod body. An antenna 32 is fitted around the antenna rod 3. One end of the antenna 32 has a circular hole 321. A screw 11 is passed through the circular hole 321 to lock the antenna on one side of the casing 10. A bulb set 31 is inlaid in the base 30 of the antenna rod 3. The bulb set 31 includes a mini-type circuit board 311 formed with multiple small thread holes 314. A color-changeable bulb 312 is arranged on the circuit board 311 and controlled thereby to flicker and change the color. Small screws 315 are screwed through the small thread holes 314 to firmly fix the bulb set 31 in the base 30.

Figure 5:
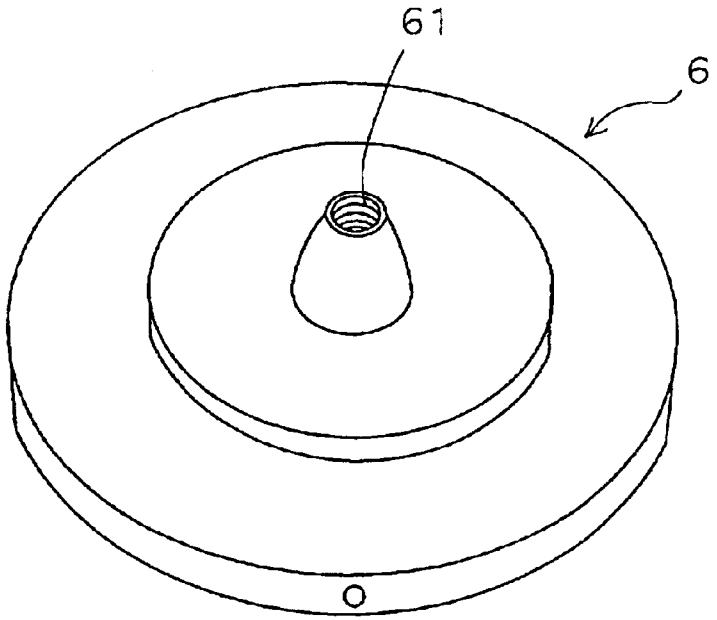
FIG. 5 is a perspective view of the antenna fixing tray of the present invention.
Figure 4:
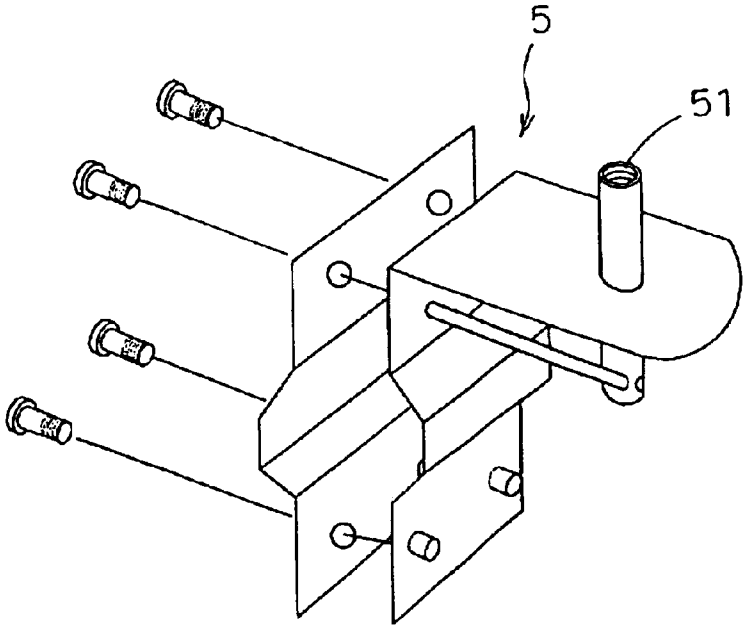
FIG. 4 is a perspective view of the antenna holder of the present invention.

The circumference of one end of the pivot rod 4 is formed with a thread 40 and the other end is formed with a threaded section 41. The thread 40 is screwed into the threaded seat 12 of the end of the main body 1. The threaded section 41 is screwed with an adaptable nut 42 and an adaptable screw 43. By means of the adaptable screw 43, the pivot rod 4 is locked in a thread hole 51 of a holder 5 or a thread hole 61 of a fixing tray 6 as shown in FIGS. 4 and 5.

Figure 2:
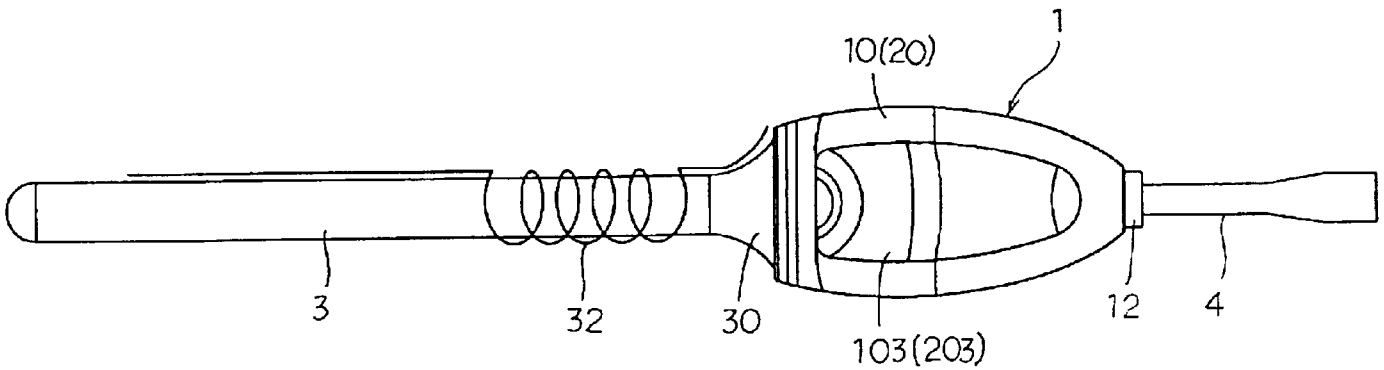
FIG. 2 is a perspective assembled view of the present invention.
Figure 3:
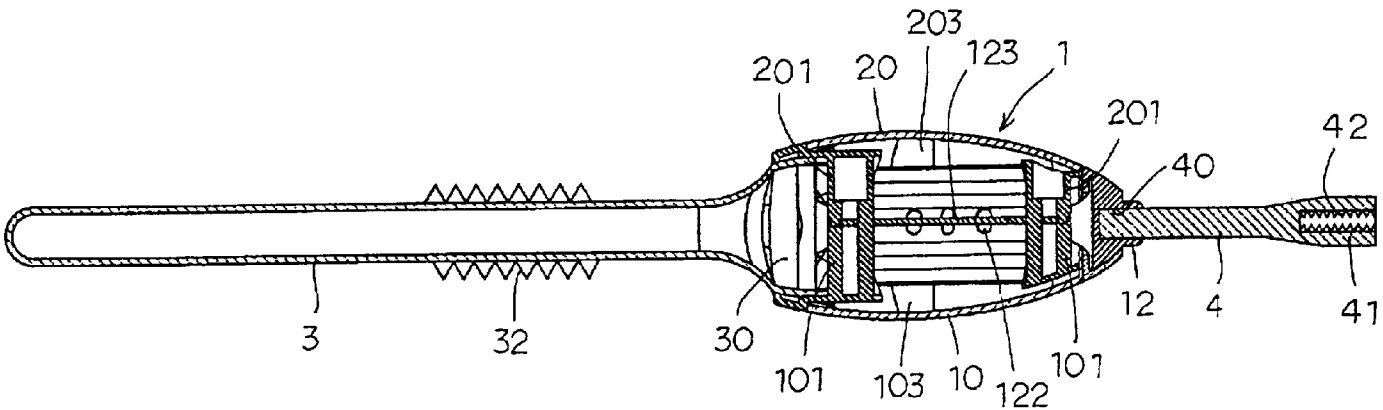
FIG. 3 is a sectional view of the present invention.

FIGS. 2 and 3 are assembled views of the car antenna seat of the present invention.

Figure 7:
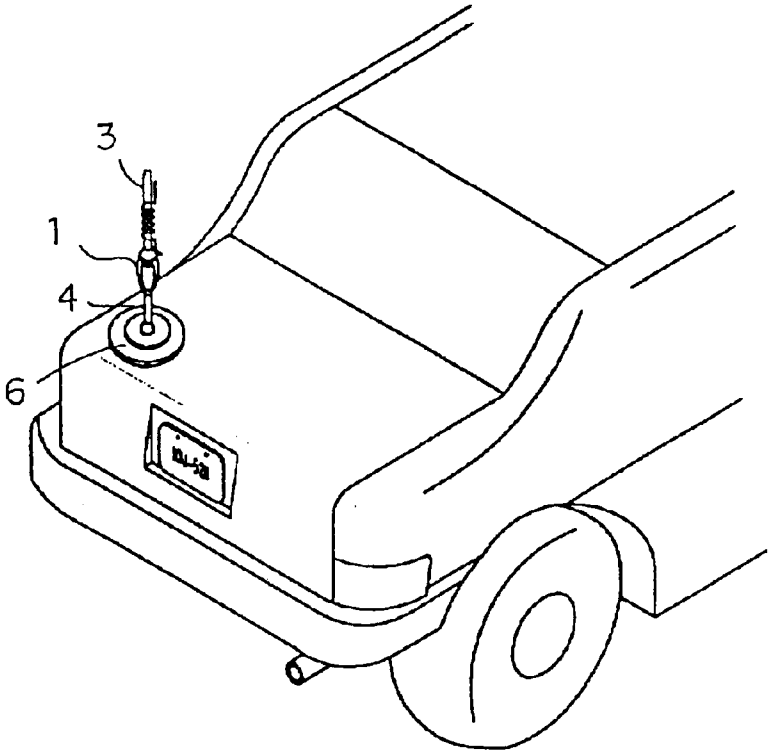
FIG. 7 shows that the present invention is mounted on the car in another state.
Figure 6:
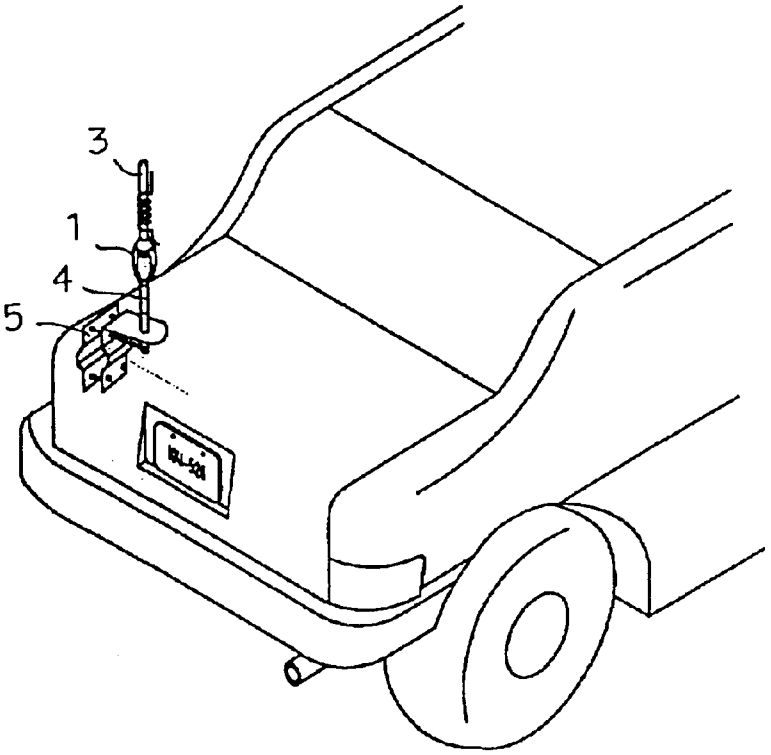
FIG. 6 shows that the present invention is mounted on a car in one state.

FIGS. 6 and 7 show the actual installation of the present invention on a car. After antenna seat is mounted and the circuit is connected, the present invention is powered on and the color-changeable bulb 312 of the bulb set 31 in the base 30 of the antenna rod 3 will emit light upward to make the entire transparent antenna rod 3 light. At the same time, the circuit board 311 will control the bulb 312 to make the antenna rod 30 present variable colors or even flicker. Simultaneously, the LED 122 disposed in the casings 10, 20 will synchronously emit light through the transparent decorative boards 103, 203, whereby the entire antenna seat main body 1 lights to achieve an indicating and warning effect as well as a unique decorative effect, especially at night.

The above embodiments are only used to illustrate the present invention, not intended to limit the scope thereof many modifications of the above embodiments can be made without departing from the spirit of the present invention.

What is claimed is:

1. Car antenna seat comprising:

a main body including two casings, inner face of each of the two casings being formed with two connecting seats corresponding to the other, the connecting seats being fitted in two screw holes of two ends of a fixing plate, several LED being respectively disposed on upper and lower faces of the fixing plate, screws being passed through the screw holes to lock the two casings into an integral body, a center of each casing being formed with a window sealed by a transparent decorative board, one end of the main body having a larger circular hole in which a base of bottom end of an antenna rod is inlaid and located, the other end of the main body having a smaller circular hole in which a threaded seat is fixed, one end of the threaded seat being formed with a thread hole, a pivot rod being screwed and located in the thread hole;

a transparent antenna rod having a straight rod body, an antenna being fitted around the antenna rod and locked on one side of the casing, bottom end of the antenna rod having a base in which a bulb set is inlaid; and a pivot rod, a circumference of one end of the pivot rod being formed with a thread and the other end being formed with a threaded section, the thread being screwed and located in the threaded seat of the end of the main body, the threaded section being screwed with an adaptable nut and an adaptable screw, whereby by means of the adaptable screw, the pivot rod is locked in a thread hole of a holder or a fixing tray.

2. Car antenna seat as claimed in claim 1, wherein a wire hole is formed on one casing near the threaded seat for wire to pass therethrough.

3. Car antenna seat as claimed in claim 1, wherein the peripheries of the decorative boards are formed with several tenons for firmly associating the decorative boards with the casings.

4. Car antenna seat as claimed in claim 1, wherein the bulb set includes a mini-type circuit board formed with multiple small thread holes, a color-changeable bulb being arranged on the circuit board and controlled thereby to flicker and change the color, small screws being screwed through the small thread holes to firmly fix the bulb set in the base.

5. Car antenna seat as claimed in claim 1, wherein the pattern of the pivot rod is selectively replaceable in accordance with the type of the car, the thread of the pivot rod being pivotally connectable with different patterns of main body.

6. Car antenna seat as claimed in claim 1, wherein the pivot rod and the threaded seat of the main body are integrally formed and the pivot rod is free from any thread or thread hole, alternatively, the pivot rod being formed with a thread for connecting with different patterns of main body.

7. Car antenna seat as claimed in claim 1, wherein by means of adaptable screw, the main body is locked and fixed with the holder or fixing tray without the pivot rod.

* * * * *